US005353043A

United States Patent [19]

Akiyama

[11] Patent Number: 5,353,043

[45] Date of Patent: Oct. 4, 1994

[54] PRINTING DATA TRANSFERRING METHOD TO A LINE HEAD

[75] Inventor: Takao Akiyama, Tokyo, Japan

[73] Assignee: Seiko Instruments Inc., Japan

[21] Appl. No.: 846,570

[22] Filed: Mar. 5, 1992

[30] Foreign Application Priority Data

Mar. 7, 1991 [JP] Japan ..... 3-043714

[51] Int. Cl.[5] ..... B61J 2/325

[52] U.S. Cl. ..... 346/76 PH

[58] Field of Search ..... 346/76 PH; 400/120

[56] References Cited

FOREIGN PATENT DOCUMENTS 0279637 8/1988 European Pat. Off. .
3628191 2/1988 Fed. Rep. of Germany .
0064965 4/1984 Japan ..... 346/76 PH
2087116 5/1982 United Kingdom .

OTHER PUBLICATIONS

Patent Abstracts of Japan, vol. 12, No. 212 (M-710) (3059), Jun. 17, 1988; & JP-A-6313756 (Seiko Instr. & Electronics).

*Primary Examiner*—Benjamin R. Fuller
*Assistant Examiner*—Huan Tran
*Attorney, Agent, or Firm*—Bruce L. Adams; Van C. Wilks

[57] ABSTRACT

A line thermal head has a head main body portion having an array of heating elements divided into a plurality of physical blocks. A head control portion divides each physical block into a plurality of division units of heating elements depending on a capacity specification of an external power source used for driving the line thermal head. The head control portion controls a printing drive operation of the heating elements. Printing data is time division transferred in accordance with the division units of heating elements, and each of the physical blocks is driven to effect printing in accordance with the time division transferring of the printing data. The size of the division units of printing elements can be set in accordance with the capacity specification of the external power source, to further reduce the size of the power source needed. A total number of heating elements energized in a printing drive operation is counted and the timing of the driving of the physical blocks is optimized depending on the counted total number so that a plurality of physical blocks can be simultaneously driven depending on the capacity specification of the external power source.

12 Claims, 5 Drawing Sheets

PRINTING DATA TRANSFERRING METHOD TO A LINE HEAD

BACKGROUND OF THE INVENTION

The present invention relates to a line thermal head and more particularly to a method of transferring printing data for a line thermal head main body.

A line thermal head has a heating array wherein a plurality of heating elements each comprising a resistor are arranged in a line. It performs printing of a line by selectively applying a driving current of several tens mA to the resistor of each heating element to cause it to heat up, thereby causing color development on a thermosensible paper, or by melting the ink on a thermal-transfer ribbon to be transferred onto a plain paper. Since a large number of heating elements is included in the heating array of a line thermal head, i.e., the number of dots per line is extremely large, if all heating elements are driven at a time, a power source having a heavy current capacity must be used. To avoid this, in a normal line thermal head, a heating array constituting one line is divided into a plurality of physical blocks, and time division driving is performed on a block basis. This allows the quantity of current consumed in one time division driving operation to be reduced and, therefore, the capacity of the power source can be reduced to some extent. If there are too many divisions, however, the writing between a head main body portion and a head control portion becomes complicated, resulting in an increase in the number of signal lines. For this reason, the linear heating array is conventionally divided into only a few blocks. As a result, the number of dots per one physical block is still considerably large.

A brief description will now be made of one a method of transferring printing data on a line basis to a line thermal head main body portion having such divided physical blocks. First, an exponent n is set to 0 at step S1 as shown in the flow chart in FIG. 5. The exponent n indicates a number assigned to each physical block. Next, a head data counter is cleared at step S2. This counter is for counting the number of dots to be printed. Then, the number of the bytes (_HBYTE_RBL[n]) of printing data to be transferred to the nth physical block specified is loaded at step S3. Further, printing data for _HBYTE_RBL[n] bytes is transferred to the head main body at step S4. At step S5, the value counted by the head data counter or a dot counter is stored in a specified area _HDOT_BL[n] of the control portion. Thus, when the printing data is transferred to the specified nth physical block, the number of dots to be printed is recorded at the same time for that physical block. Next, the exponent n is updated to n+1 at step S6. Thereafter, the process returns to step S2 to transfer printing data for the (n+1)th physical block and record the number of dots to be printed. Thus, transfer of printing data is sequentially performed for each physical block.

A conventional method of driving a line thermal head will now be briefly described with reference to the flow chart in FIG. 6. First, printing data is transferred to a head main body portion at step S1. This transfer method is as shown in the flow chart in FIG. 5. Next, a driving pattern of the line thermal head is decided at step S2. The driving pattern means the timing for the application of a current to each physical block. Specifically, the timing for the application of a current to each physical block is set in accordance with the number of dots to be printed recorded at step S5 in the flow chart shown in FIG. 5. When the total number of dots to be printed, i.e., the total number of the heating elements to which a current is to be supplied is large, each physical block is driven on a time division basis and, conversely, when the number is small they are driven at a time. At step S3, the line thermal head is driven to perform printing in accordance with the driving pattern thus set.

As described above, in the conventional method of transferring printing data, printing data for one line is simply supplied to the head main body portion for every transfer process in order to perform high speed printing using simple transfer control. Therefore, when line printing is performed in accordance with the printing data which has been transferred, even if the time division driving is sequentially performed for each physical block, the maximum number of-dots printed in one driving process is equal to the number of heating elements included in a physical block. That is to say that the conventional method does not allow the maximum number of dots printed in one driving process to be set to a value which is smaller than the number of heating elements included in a physical block (the largest physical block when the physical blocks vary in size).

BRIEF SUMMARY OF INVENTION

When a line thermal head is driven in accordance with the conventional method as described above, the capacity of the current to be supplied by a power source used will be (the number of heating elements included in the largest physical block) X (the value of the current consumed by one heating element). Accordingly, the conventional method still requires a driving power source requiring a large current capacity. In other words, the maximum number of dots printed which is allowed in one driving process can not be set to a value which is smaller than the number of heating elements included the largest physical block. Therefore, in spite of the fact that the percentage printed, i.e., the percentage that the number of dots printed occupies in the total number of dots, is not so high in printing of common characters and the like, it is necessary to prepare a power source having a current capacity which is sufficient for driving at least each individual physical block taking into consideration the case wherein all dots are energized. This has resulted in a problem that a large power source must be used in spite of the fact that a thermal head itself can be made compact.

In order to solve the above-mentioned problem in the prior art, a line thermal head according to the present invention has a configuration as described below. It basically has a head main body portion which has a linear array of heating elements divided into a plurality of physical blocks and which can be driven to perform a printing process on a physical block basis, and a head control portion (e.g., a one-chip CPU) which performs a printing data transfer process and printing drive control for the head main body portion. The head control portion is characterized in that it has a transfer means for performing a time division transfer process on the printing data in accordance with division units obtained by further dividing the printing data assigned to each physical block, and a driving means for performing printing drive for each physical block in accordance with the time division transfer process.

Preferably, the head control portion has a setting means for properly setting the size of the division units in accordance with the capacity specification of an external power source used for the driving of the line thermal head.

More preferably, the head control portion is equipped with a counting means for counting the total number of the heating elements energized at each printing drive operation, and the driving means includes a means for performing control so that the timing of the driving of each physical block is optimized in accordance with the results of the counting.

DETAILED DESCRIPTION OF THE INVENTION

Figure 1A:
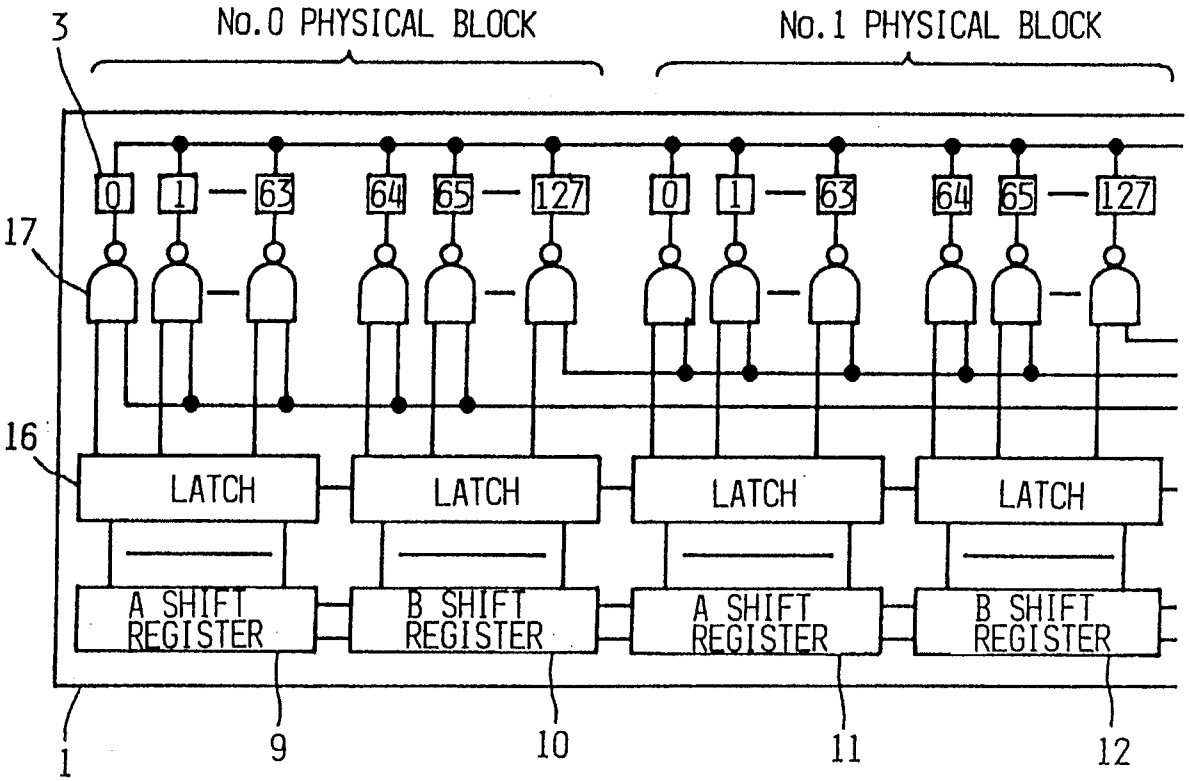
FIGS. 1A, 1B combined is a typical block diagram showing a basic configuration of a line thermal head according to the present invention.
Figure 1B:
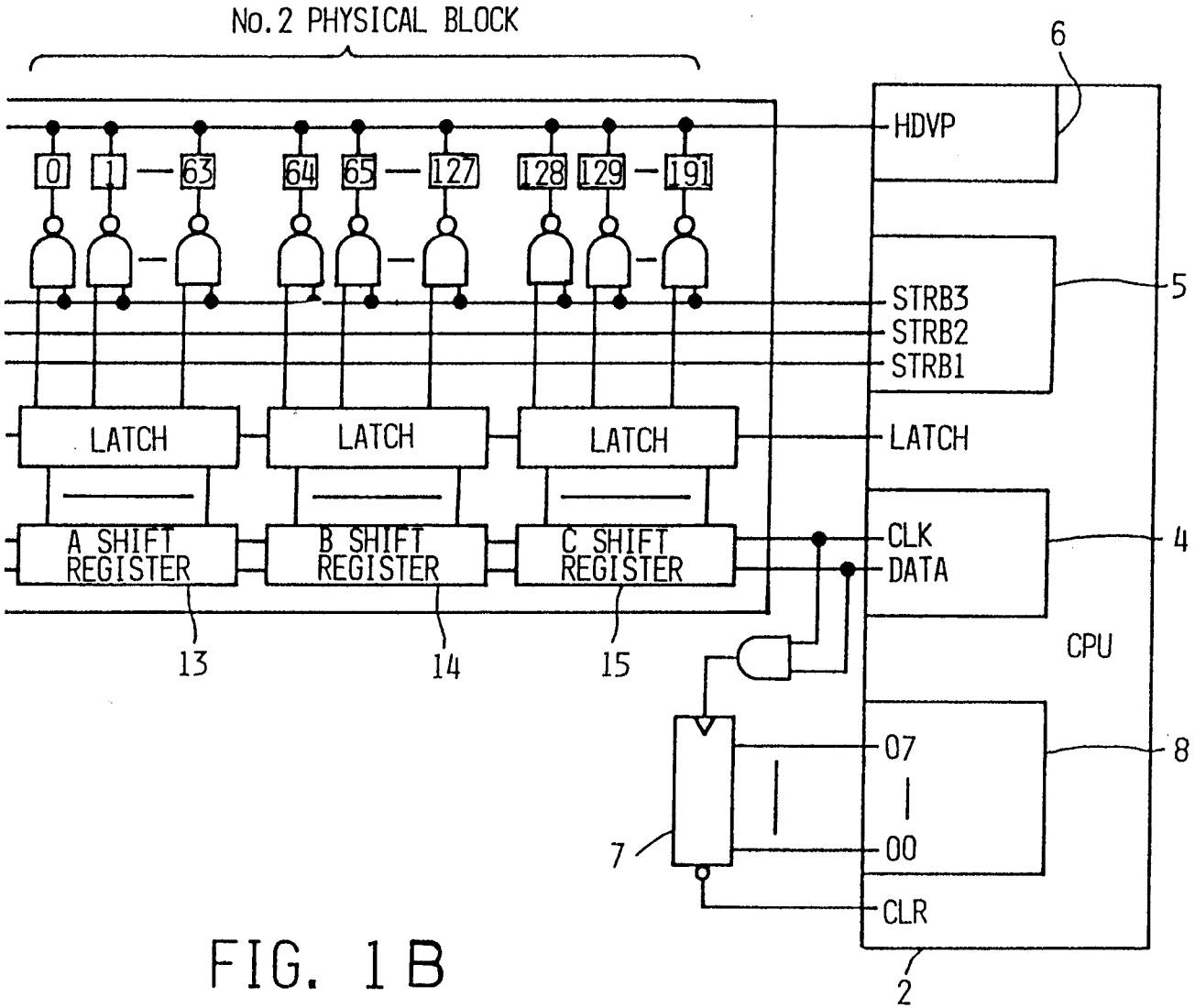

An embodiment of the present invention will now be described in detail with reference to the drawings. FIGS. 1A, 1B is a typical circuit block diagram illustrating the overall configuration of a line thermal head according to the present invention. As shown, the line thermal head comprises a head main body portion 1 and a head control portion 2. The head control portion 2 is constituted, for example, by a one-chip CPU and connected to the head main body portion via various signal lines. The head main body portion 1 includes a multiplicity of heating elements 3. The heating elements 3 are arranged on a straight line on a substrate of the head main body portion 1 to constitute a linear array. This array is divided into a plurality of physical blocks. In the present embodiment, it is divided into three parts and has no. 0 physical block, no. 1 physical block and no. 2 physical block. No. 0 physical block includes 128 pieces of heating elements 3 which are numbered 0–127, respectively. No. 1 physical block also includes 128 pieces of heating elements. No. 2 physical block includes 192 pieces of heating elements. The above three physical blocks can be individually driven for printing.

The head control portion 2 performs a printing data transfer process and control of a printing drive operation of the head main body portion 1. The head control portion 2 is equipped with transfer means 4 which performs a time division transfer process on printing data in accordance with division units obtained by further dividing the printing data assigned to each physical block. In the present embodiment, a division unit is set to 64. This is to say that a printing data transfer process is performed taking 64 bits or 8 bytes as one unit. The transfer of printing data is performed byte by byte in synchronism with a clock signal CLK via a signal line DATA. The head control portion 2 further incorporates driving means 5 which performs printing drive for each physical block in accordance with the above-mentioned time division transfer process on each physical block. In the present embodiment, the control of the driving of no. 0 physical block is performed by a strobe signal STRB1; the control of the driving of no. 1 physical block is performed by a strobe signal STRB2; and the control of the driving of no. 2 physical block is performed in accordance with a strobe signal STRB3. The head control portion 2 is further equipped with setting means 6 for setting the size of the division units in accordance with the capacity specification of an external power source used for driving the line thermal head. In the present embodiment, the number of the heating elements 3 included in one division unit is 64 as previously described. However, the present invention is not limited thereto, and the division units may take a smaller value, e.g., 32. The capacity specification of the power source used may be thus reduced further. HDVP in the drawing represents a power source line. The head control portion 2 includes counting means 7 which counts the total number of heating elements energized in each printing drive operation. The counting means 7 is constituted by an 8-bit counter, for example, and normally referred to as a dot counter. Optimizing means 8 is connected to the counting means 7, the optimizing means 8 generating a driving pattern for controlling so that the timing for driving of each physical block is optimized in accordance with results D0–D7 of the counting. In accordance with this driving pattern, the driving means 5 actually controls the energization of each physical block. The counting means 7 or dot counter is appropriately cleared in accordance with a clear signal CLR.

Returning now to the head main body portion 1 for detailed description, the head main body portion 1 incorporates a plurality of shift registers corresponding to the division units each including 64 pieces of heating elements 3. Specifically, no. 0 physical block includes an A shift register 9 and a B shift register 10; no. 1 physical block includes an A shift register 11 and a B shift register 12; and no. 2 physical block includes an A shift register 13, a B shift register 14 and a C shift register 15. Printing data DATA transferred from the head control portion 2 is sequentially forwarded to the series of shift registers 9–15 in synchronism with the clock signal CLK. Corresponding latches 16 are connected to each individual shift registers 9–15. The latches 16 are for temporarily retaining printing data stored in the respective shift registers on a division unit basis. They are controlled by a latch signal LATCH, read printing data stored in the shift registers in a period of high level, and exhibit no change in their outputs even if there is a change in the contents of the shift registers in a period of low level. The outputs of the latches are connected to a driver stage 17 comprising a plurality of AND gates and ORed with the respective strobe signals for each physical block. For example, when the strobe signal STRB1 is switched on, the heating elements included in no. 0 physical block is selectively driven so that the heating resistors cause color development on a thermosensible paper or melt a thermal-transfer ribbon so as to transfer it onto a plain paper, performing line printing.

In the line thermal head having the configuration as described above, the transfer means provided on the head control portion 2 performs a time division transfer process on printing data in accordance with the division units which have been preset as previously mentioned. In the present embodiment, for example, printing data for a division unit is sequentially progressively transferred to the A shift register 9 of no. 0 physical block, the A shift register 11 of no. 1 physical block, and the A shift register 13 of no. 2 physical block in the first transfer process. In the second transfer process, printing data for a division unit is sequentially progressively transferred to the B shift register 10 of no. 0 physical block, the B shift register 12 of no. 1 physical block, and the B shift register 14 of no. 2 physical block. Finally, printing data for one division unit is stored in the remaining C shift register 15 of no. 2 physical block in the third transfer process. On the other hand, the driving means 5 incorporated in the head control portion 2 performs printing driving of each physical block in accordance with the time division transfer process as previously mentioned. In the present embodiment, for example, at a point in time when the first transfer process is complete, the strobe signal STRB1 is switched on to drive no. 0 physical block. In this state, since printing data is stored only in the A shift register 9 of no. 0 physical block, only 64 pieces of heating elements 3 are energized even if full dot printing is performed. In other words, only half of the 128 pieces of heating elements included in no. 0 physical block are energized. Therefore, it is possible to halve the capacity specification of the power source used as compared to the prior art. Next, no. 1 physical block is driven by switching the strobe signal STRB2 on. Since printing data is stored only in the A shift register 11 at a point in time when the first transfer process is complete, only 64 pieces of heating elements 3 are energized even if full dot printing is performed. Finally, the strobe signal STRB3 is switched on to energize only the heating elements 3 of no. 2 physical block corresponding to the A shift register 13. In the above-described case, the sequential energizing process is performed for each physical block. However, depending on the results of the counting performed by the counting means 7, there may be cases wherein the percentage printed is low and the total number of dots energized is small such as to case of the ordinary character printing. In such cases, it is possible to drive no. 0, no. 1 and no. 2 physical blocks at a time in accordance the driving pattern obtained by the optimizing means 8. In other words, the strobe signals STRB1, STRB2 and STRB3 can be switched on at a time. This optimizing process is performed for every transfer process.

Figure 2:
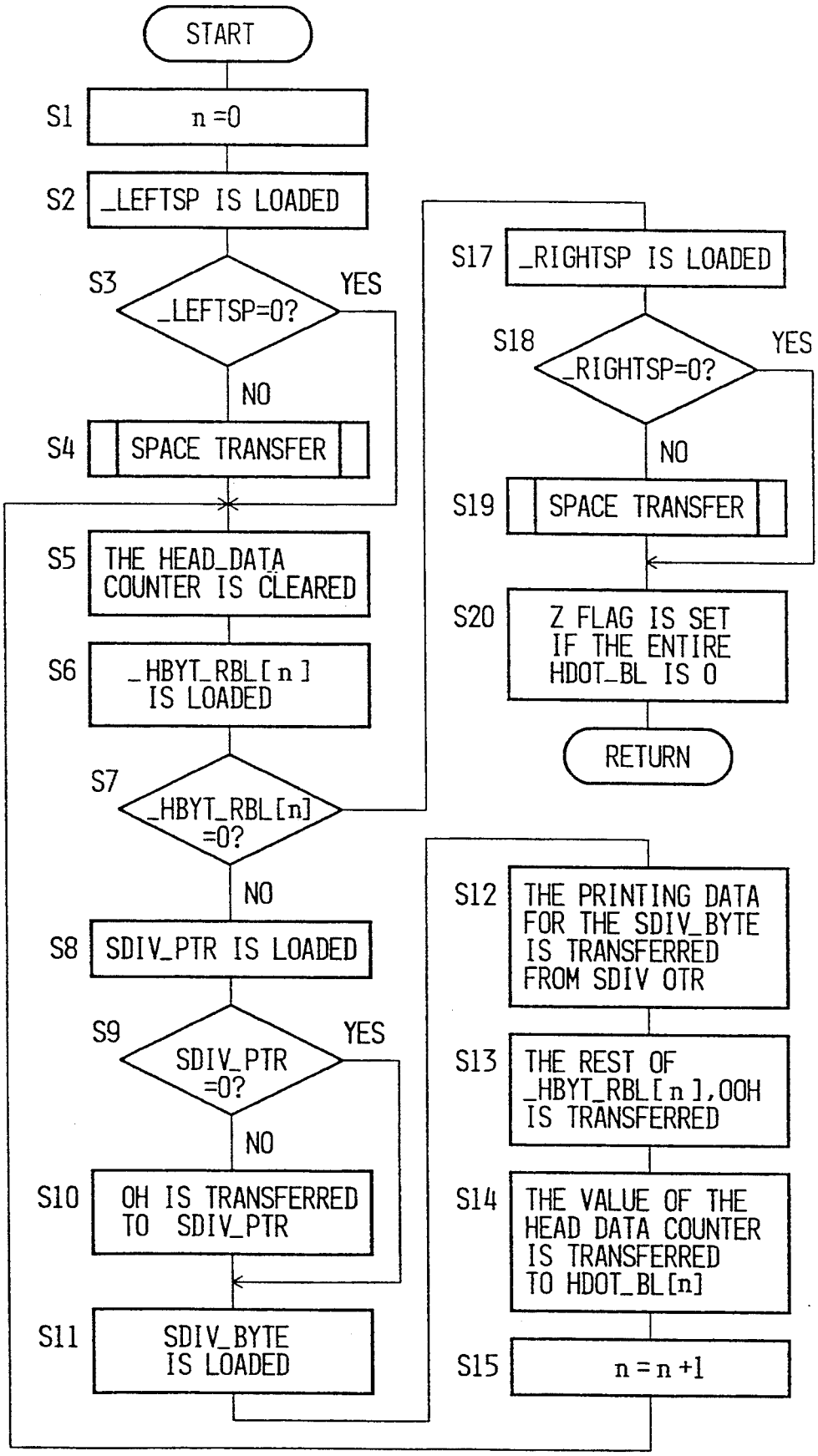
FIG. 2 is a flow chart for explaining a printing data transfer operation of the line thermal head shown in FIGS. 1A, 1B.
Figure 3:
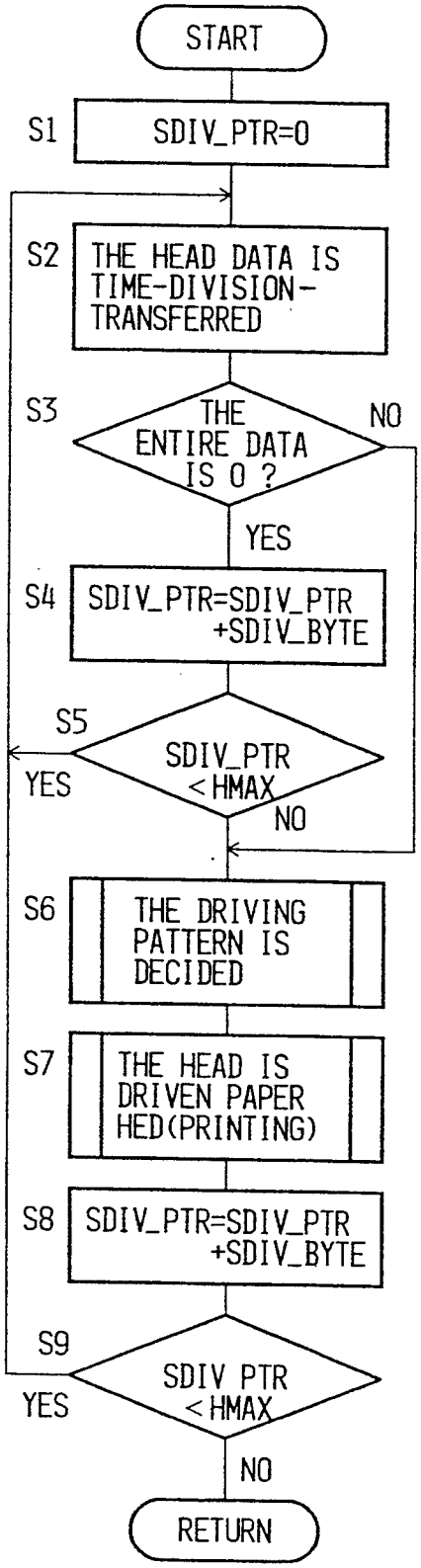
FIG. 3 is a flow chart for explaining a printing operation of the line thermal head shown in FIGS. 1A, 1B.
Figure 4:
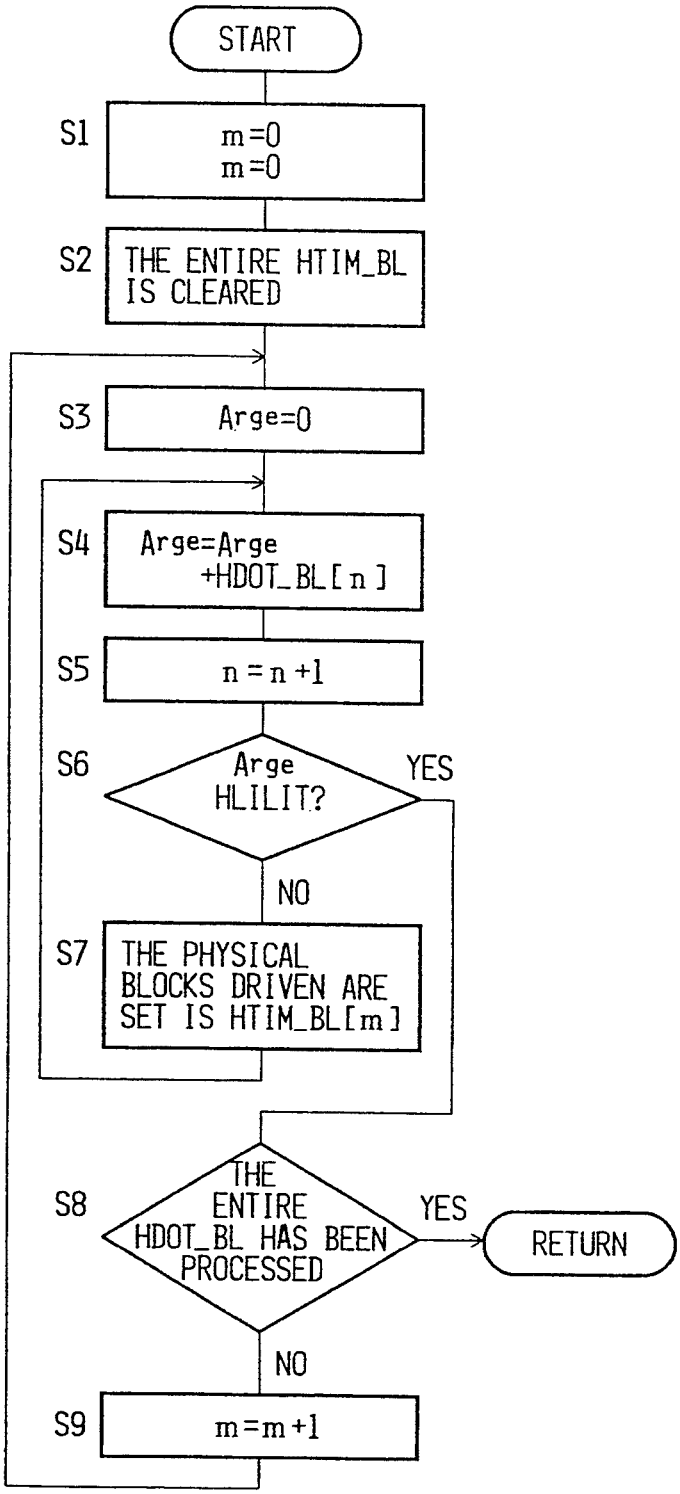
FIG. 4 is a flow chart for explaining a driving pattern optimizing operation of the line thermal head shown in FIGS. 1A, 1B.
Figure 5:
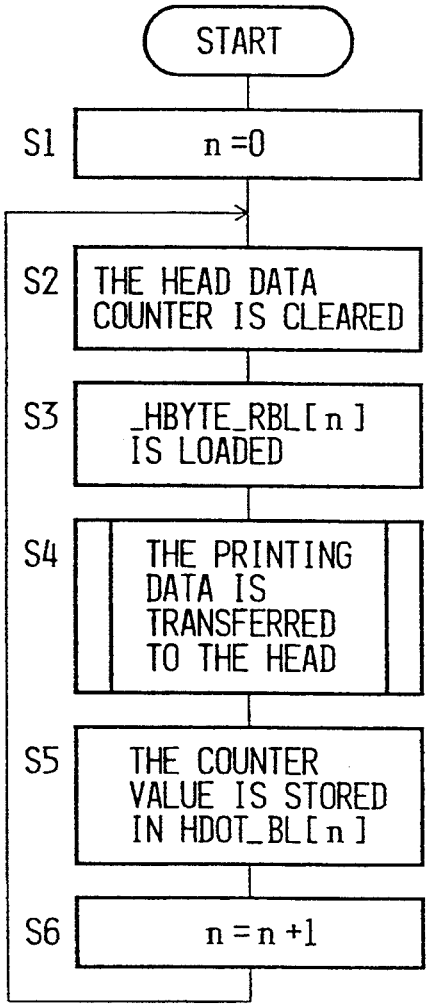
FIG. 5 PRIOR ART
FIG. 5 is a flow chart for explaining a printing data transfer method of a conventional line thermal head.
Figure 6:
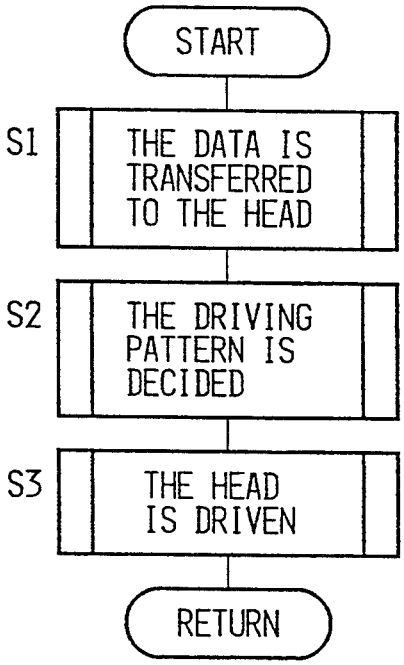
FIG. 6 PRIOR ART
FIG. 6 is a flow chart for explaining a driving method of a conventional line thermal head.

Finally, the operation of the line thermal head shown in FIGS. 1A, 1B will be described with reference to FIG. 2–FIG. 4. FIG. 2 is a flow chart for explaining a time division transfer process in accordance with the division units of printing data or a software dynamic split transfer process. An exponent n is first set to 0 at step S1. The exponent n represents a number given to each physical block. At step S2, the number of bytes (_LEFTSP) of a non-printing portion at the left-hand side (left margin) is loaded. At step S3, if _LEFTSP is 0, a jump to step S5 to be described later takes place. That is to say that no margin is specified. On the other hand, if _LEFTSP is not 0, the process proceeds to step S4 wherein space data for _LEFTSP is transferred. Specifically, printing data 00H is transferred. At step S5 the head data counter or dot counter 7 is cleared. At step S6, the number of bytes of the printing data assigned to the specified nth physical block (—HBYT_RBL[n]) is loaded. At step S7, it is determined whether the _HBYT_RBL[n] loaded is 0. If so, a jump to step S17 to be described later takes place. That is, a physical block other than no. 0 –no. 2 blocks is specified. Since such a physical block does not exist in the present embodiment, the number of the bytes of the said physical block is preset to 00H. On the other hand, if the _HBYT_RBL[n] is not 0, the process proceeds to step S8 wherein the starting point for the printing data transfer to the specified physical block (SDIV_PTR) is loaded. For example, when printing data for a division unit is stored in the A shift register 9 in no. 0 physical block, the SDIV_PTR is set to 0. On the other hand, when printing data for a division unit is stored in the B shift register 10 in the same no. 0 physical block, the SDIV_PTR is set to 64.

At step S9, it is determined whether the SDIV_PTR loaded is 0. If so, a jump to step S11 later takes place. On the other hand, if it is not 0, the process proceeds to step S10 wherein the printing data OOH is stored in a register before the starting point for the data transfer SDIV_PTR. For example, the actual printing data is stored in the B shift register 10 in no. 0 physical block with the A shift register 9 blanked. Next, the number of bytes of printing data included in a division unit (SDIV_BYTE) is loaded at step S11. That is, the size of a division unit is set to be appropriate for the capacity specification of the power source used. In the present embodiment, one division unit includes 64 bits, i.e., 8 bytes. At step S12, printing data for the SDIV_BYTE i.e., 8 bytes starting from the starting point for the data transfer SDIVPTR is transferred to a specified shift register of a specified physical block. At step S13, the printing data OOH is transferred to the specified physical block in a quantity corresponding to the number of bytes that remain in the physical block after the number of bytes _HBYT_RBL[n] is assigned. For example, when the actual printing data is stored in the A register 9 of no. 0 physical block, the blank printing data 00H is stored in the remaining B shift register 10. At step S14, a value counted by the dot counter 7 is stored in an area _HDOT_BL[n] which has been specified. This terminates the printing data transfer for one division block for a specified physical block. Thereafter, the exponent n is updated and set to n+1 at step S15. That is, the above procedures are repeated for the next physical block.

At a point in time when the printing data transfer for one division block is finished for the last no. 3 physical block, the process jumps from step S7 to step S17 as previously mentioned. At step S17, the number of the bytes (_RIGHTSP) of a non-printing portion at the right-hand side (right margin) is loaded. At step S18, it is determined whether the number of the bytes of the right margin is 0. If so, a jump to step S20 takes place. On the other hand, if it is not 0, the blank printing data OOH is transferred to the head main body portion 1 in a quantity corresponding to the _RIGHTSP because there is a right margin. Finally, at step S20, if the entire area HDOT_BL[n] wherein values counted by the dot counter are stored on a physical block basis, is 0, a ZERO flag is set. This is a case wherein no heating element to be energized exists. The above procedure terminates one time division transfer operation on printing data in accordance with the division units or a software dynamic split transfer operation.

A detailed description will now be made with reference to FIG. 3 for a method of driving the line thermal head at a point in time when one time division transfer operation is complete. First, at step S1, a starting point of printing data transfer or a printing data transfer starting pointer SDIV_PTR is set to 0 as previously mentioned. Next, the time division transfer of printing data in accordance with the division units is performed once for each physical block at step S2. This time division transfer is performed in accordance with the procedures represented by the flow chart shown in FIG. 2. Then, it is determined whether the entire printing data which has been time-division-transferred this time, is 0 at step S3. If not, a jump to step S6 to be described later takes place. On the other hand, if it is determined that the entire data is 0, the process proceeds to step S4. At this step S4, the current data transfer starting pointer SDIV_PTR is added with the number of bytes SDIV_BYTE of printing data included in the division unit, the result thereof being stored in the SDIV_PTR again. Next, the process proceeds to step S5 wherein determination is made on whether the SDIV_PTR is smaller than the maximum number of bytes of a physical block (HMAX). If so, a jump to step S2 takes place because the time division transfer of printing data for the physical block has not been finished. On the other hand, if the SDIV_PTR is not smaller than the maximum number of bytes of a physical block HMAX, the data transfer for the physical block has been finished, and the process then proceeds to step S6.

At step S6, the driving pattern for the line thermal head or the timing for the energization of each physical block is decided. The specification of the driving pattern is illustrated in the flow chart in FIG. 4 to be described later. At step S7, line printing is preformed by driving the head main body portion 1 in accordance with the driving pattern specified at step S7, and a paper feed operation is performed as required. The driving of the head may be performed in two manners i.e., a manner wherein each of the physical blocks are sequentially selected and a manner wherein they are selected at a time. At step S8, the printing data transfer staring pointer SDIV_PTR is added with the number of bytes SDIV_BYTE of printing data included in the division unit, and the said pointer is thus updated. Finally, at step S9 it is determined whether the pointer SDIV_PTR updated at step S9 is smaller than the maximum number of bytes of the printing data assigned to a physical block (HMAX). If so, a jump to step S2 takes place because the transfer of the entire printing data has not been finished. On the other hand, if the pointer SDIV_PTR is not smaller than the maximum number of bytes HMAX, return takes place.

Finally, a method of deciding a driving pattern for the head will be described with reference to FIG. 4. At step S1, initialization is carried out by setting given exponents n and m to 0. Then, the entire area (HTIM_BL) for registering a physical block to be driven is cleared and initialized at step S2. Then, at step S3, register for calculation Areg is set to 0. At step S4, the register for calculation Areg is added with the number of dots to be printed HDOT_BL[n] included in the specified nth physical block. The exponent n is updated at step S5. At step S6, the numerical value in the register for calculation of Areg is compared with a preset maximum allowable number for dots printed (HLIMIT). If the numerical value in the register Areg is larger than the maximum allowable number for dots printed HLIMIT, a jump to step 8 takes place. On the other hand, if it is smaller, the process proceeds to step 7 wherein the n bit of the above-described registration area (HTIM_BL[m]) of the physical blocks to be driven, is set. The n bit corresponds to the physical block to be driven. Then, the process returns to step S4.

At step S8, it is determine whether the entire HDOT_BL has been processed. If so, return takes place. On the other hand, if not, the exponent m is updated at step S9. Then, a jump to step 3 takes place. The driving pattern for the head is thus decided. That is, a plurality of physical blocks are energized simultaneously as long as the maximum allowable number of dots printed is not exceeded, whereby the speed of printing is increased. Since the precentage printed is low in the case of printing of characters and the like in general, it is normally possible to drive all physical blocks at a time within a range smaller than the maximum allowable number of dots printed. On the other hand, when full dot printing for one line is performed, it is inevitable to perform driving on a time series basis for each physical block.

As described above, by employing the method of controlling printing data in accordance with division units according to the present invention, it is possible to carry out the setting of the maximum allowable number of dots printed to a value smaller than the number of heating elements included in the largest physical block, which has been impossible in the past. This provides an advantage that a power source used can be selected more freely and a power source having a current capacity smaller than that in the prior art can be used. Though the size of a power source has been an obstacle to efforts at making a thermal printer smaller, the control method according to the present invention overcomes this. In addition, since the average percentage printed per line is low in normal character printing, there is an advantage that printing can be performed at an operation speed which is not so lower than that in the prior art even if the time division transfer in accordance with the division units is performed.

What is claimed is:

1. A line thermal head, comprising: a head main body portion having a linear array of heating elements divided into a plurality of physical blocks drivable so as to perform printing on a physical block basis; and a head control portion for performing a printing data transfer process and printing drive control for the head main body portion, the head control portion including transferring means for performing a time division transfer process on printing data in accordance with division units obtained by further dividing the printing data assigned to each of the physical blocks, and driving means for driving each of the physical blocks to effect printing in accordance with the time division transfer process performed on the printing data.

2. A line thermal head according to claim 1; wherein the head control portion further includes setting means for setting a size of the division units in accordance with a capacity specification of an external power source used for driving the line thermal head.

3. A line thermal head according to claim 1; wherein the head control portion further includes counting means for counting a total number of the heating elements energized at each printing drive operation, and optimizing means for controlling a timing of the driving of each of the physical blocks to be optimized in accordance with a results of the counting.

4. A line thermal head, comprising: a head main body portion having an array of heating elements divided into a plurality of physical blocks; and a head control portion for dividing each of the physical blocks into a plurality of division units of heating elements depending on a capacity specification of an external power source used for driving the line thermal head, and for controlling a printing drive operation of the heating elements.

5. A line thermal head according to claim 4; wherein the head control portion includes means for dividing each of the physical blocks into a plurality of division units of heating elements depending on printing data assigned to each of the physical blocks.

6. A line thermal head according to claim 5; wherein the head control portion includes transferring means for time division transferring of printing data in accordance with the division units of heating elements, and driving means for driving each of the physical blocks to effect printing in accordance with the time division transferring of the printing data.

7. A line thermal head according to claim 4; wherein the head control portion includes setting means for setting a size of the division units of heating elements in accordance with the capacity specification of the external power source.

8. A line thermal head according to claim 4; wherein the head control portion includes counting means for counting a total number of heating elements energized in the printing drive operation.

9. A line thermal head according to claim 8; wherein the head control portion further includes driving means for driving each of the physical blocks, and optimizing means for optimizing a timing of the driving of each of the physical blocks depending on a counted total number of energized heating elements so as to simultaneously drive a plurality of the physical blocks depending on the capacity specification of the external power source.

10. A line thermal head, comprising: a head main body portion having an array of heating elements divided into a plurality of physical blocks; and a head control portion for dividing each of the physical blocks into a plurality of division units of heating elements depending on printing data assigned to each of the physical blocks and controlling a printing drive operation of the heating elements, the head control portion including setting means for setting a size of the division units of heating elements in accordance with a capacity specification of an external power source used for driving the line thermal head, transferring means for time division transferring of printing data in accordance with the division units of heating elements, and driving means for driving each of the physical blocks to effect printing in accordance with the time division transferring of the printing data.

11. A line thermal head according to claim 10; wherein the head control portion further includes counting means for counting a total number of heating elements energized in the printing drive operation.

12. A line thermal head according to claim 11; wherein the head control portion further includes optimizing means for optimizing a timing of the driving of each of the physical blocks depending on a counted total number of energized heating elements so as to simultaneously drive a plurality of the physical blocks depending on the capacity specification of the external power source.

* * * * *